US006169238B1

(12) United States Patent
Bolo, III

(10) Patent No.: US 6,169,238 B1
(45) Date of Patent: Jan. 2, 2001

(54) COMBINATION STRAP LOCK AND PICK STORAGE DEVICE

(75) Inventor: Robert T. Bolo, III, New York, NY (US)

(73) Assignee: BoloPick, New York, NY (US)

( * ) Notice: Under 35 U.S.C. 154(b), the term of this patent shall be extended for 0 days.

(21) Appl. No.: 09/363,587

(22) Filed: Jul. 29, 1999

(51) Int. Cl.[7] ..... G10G 7/00

(52) U.S. Cl. ..... 84/453; 84/321; 84/329; 84/320; 24/545

(58) Field of Search ..... 84/320, 321, 329, 84/453, 458; 24/545, 567, 664

(56) References Cited

U.S. PATENT DOCUMENTS

| | | | | |
|---|---|---|---|---|
| D. 309,674 | | 8/1990 | Gervase | D3/30.1 |
| D. 355,667 | | 2/1995 | Burger | D17/20 |
| D. 362,264 | | 9/1995 | Trees | D17/20 |
| D. 393,362 | | 4/1998 | Byers | D3/204 |
| 1,020,961 | * | 3/1912 | Butcher, Jr. | 24/545 |
| 2,548,254 | * | 4/1951 | Churchill, Jr. | 24/567 |
| 3,688,012 | | 8/1972 | Vettel | 84/327 |
| 3,894,464 | | 7/1975 | Brooks | 84/327 |
| 4,014,240 | | 3/1977 | Pullen | 84/327 |
| 4,028,981 | | 6/1977 | Cravens | 84/327 |
| 4,067,255 | | 1/1978 | Camaioni | 84/322 |
| 4,135,431 | | 1/1979 | Ferguson | 84/329 |
| 4,144,794 | | 3/1979 | Silverman et al. | 84/327 |
| 4,188,851 | | 2/1980 | Wolf | 84/327 |
| 4,271,999 | | 6/1981 | Stravitz | 224/257 |
| 4,274,181 | | 6/1981 | Schaller | 24/201 A |
| 4,291,822 | | 9/1981 | Simonds | 224/257 |
| 4,357,063 | | 11/1982 | Gray | 339/75 P |
| 4,370,040 | | 1/1983 | Lange | 354/288 |
| 4,569,105 | * | 2/1986 | Weider | 482/107 |
| 4,592,266 | | 6/1986 | Daugherty | 84/327 |
| 4,779,778 | | 10/1988 | Nixon, II | 224/269 |
| 4,785,708 | | 11/1988 | Vaughan | 84/329 |
| 4,843,943 | | 7/1989 | Hoshino | 84/327 |
| 4,901,900 | | 2/1990 | Goto | 224/257 |
| 4,993,127 | | 2/1991 | Mechem et al. | 24/701 |
| 5,299,485 | | 4/1994 | Denton | 84/329 |
| 5,413,020 | | 5/1995 | Thompson | 84/329 |
| 5,488,892 | | 2/1996 | Jepsen | 84/322 |
| 5,651,468 | | 7/1997 | Irizarry | 211/120 |
| 5,739,445 | | 4/1998 | Terry et al. | 84/329 |
| 5,796,021 | | 8/1998 | Longshore | 84/329 |
| 5,847,299 | | 12/1998 | Zovko, Jr. et al. | 84/329 |

* cited by examiner

*Primary Examiner*—Robert E. Nappi
*Assistant Examiner*—Shih-yung Hsieh
(74) *Attorney, Agent, or Firm*—Baker & Daniels

(57) ABSTRACT

A combination strap lock and pick storage device includes a pair of arms each having a free end and an opposite end forming a single ring defining a passage therethrough. The arms are biased away from each other such that the passage has a predefined cross-sectional area. The arms may be forced toward each other to thereby expand the cross-sectional area of the passage sufficiently to thereby allow passage therethrough of an enlarged head of a peg attached to a musical instrument. Thereafter, the arms may be released so that the passage resumes its predefined cross-sectional area and engages a shaft portion of the peg, wherein the shaft has a cross-sectional area that is less than that of the enlarged head. The device thus secures a support strap, previously attached to the peg, to the musical instrument. Each arm additionally defines a channel along an inside surface thereof, wherein the opposing channels are configured to receive a flat pick therein. The device is configured such that the pick may be easily advanced into, or retrieved from, the channels defined in each of the arms.

19 Claims, 5 Drawing Sheets

COMBINATION STRAP LOCK AND PICK STORAGE DEVICE

FIELD OF THE INVENTION

The present invention relates generally to accessories for musical instruments, and more specifically to such accessories operable to maintain connection of a strap to the musical instrument and to further provide a pick storage structure for a stringed instrument in particular.

BACKGROUND OF THE INVENTION

Heretofore, musicians and musical instrument designers have adapted their instruments and devised various devices to enable the instruments to be played in a variety of different positions. For example, many stringed instruments such as guitars, mandolins, banjos and the like include one or more pegs affixed thereto for engaging a support strap, whereby the instrument may be suspended by the strap from the musician's body to enable mobile playing thereof.

Typically, the one or more pegs affixed to the stringed instrument include an enlarged head portion having a reduced diameter shaft or shank extending therefrom wherein the free end of the shaft is affixed to the instrument by various known means. Conventional support straps define an aperture therethrough adjacent at least one end thereof, wherein the aperture typically includes a slit extending therefrom. The aperture of the strap is forced over the head of a corresponding peg and onto the shaft to thereby connect the support strap to the instrument. In this process, the slit is generally operable to separate as the aperture is forced over the head, thereby effectively enlarging the aperture opening sufficiently to allow passage of the enlarged head therethrough.

The regions of the support strap defining the above-described aperture/slit configuration are typically formed of a semi-flexible material such as leather, vinyl or the like. Such materials are known to stretch and/or deform through repeated engagement and disengagement with the instrument peg, and support strap apertures thus tend to become enlarged and the slits overly flexible through normal use. Accordingly, there exists an ever-increasing possibility that the strap aperture may slip over the enlarged head of the peg, thereby disengaging the instrument from its wearer. Potential damage to, or destruction of, the instrument could result.

The foregoing problem associated with the above-described instrument/strap attachment structures has been addressed heretofore, and a number of strap locking and/or latching devices have been devised to ensure secure attachment of the support strap to the instrument. One approach to such a strap locking device includes modifying the instrument peg to include a strap locking feature. Examples of such devices are disclosed in U.S. Pat. Nos. 3,894,464, 4,014,240, 4,028,981, 4,144,794, 4,274,181, 4,291,822, 4,592,266, 4,843,943 and 4,901,900. While such devices are generally operable to provide adequate strap locking capabilities, they have certain drawbacks associated therewith. For example, the disclosed strap locking devices are designed to replace existing instrument pegs, and the mounting of such structures typically requires modifications to the instrument itself. Many musicians, particularly those who own and routinely play vintage or collectable instruments, desire to maintain the originality of their instruments and therefore will not use such devices. Moreover, many of these peg replacement devices are complicated and cumbersome to use.

Another known approach to strap locking devices includes modifying the strap to include a strap locking feature. Examples of such devices are disclosed in U.S. Pat. Nos. 3,688,012, 4,188,851, 4,271,999, 4,370,040 and 4,993,127. While such devices are generally operable to provide adequate strap locking capabilities, they have certain drawbacks associated therewith. For example, such devices are typically complicated and expensive to manufacture. Moreover, many musicians prefer to use customized straps that may not include, and may not be modifiable to include, such strap locking features.

Yet another known approach to strap locking devices includes providing a locking structure that is independent of both the strap and the instrument peg. An example of one such device is disclosed in U.S. Pat. No. 4,357,063 and includes a pair of juxtaposed disk-like structures each defining an aperture therethrough. The disks are rotatably connected such that the two apertures align in one position to allow passage therethrough of the enlarged head of the instrument pin. With the device apertures positioned about the reduced diameter shaft of the pin, one disk is rotated relative to the other such that the two apertures align in a second position having a diameter that is smaller than the head of the instrument pin. While this device overcomes some of the drawbacks of the above-described strap locking devices by providing a strap locking structure that is independent of both the support strap and the instrument pin, it has its own drawbacks associated therewith. For example, the dual-disk structure is complicated in its manufacture and assembly, and is further cumbersome and difficult to operate.

Another problem associated with the mobile playing of an instrument, and particularly of a stringed instrument, is the ready availability to the musician of needed musical accessories. For example, many guitar and mandolin players use flat picks, which may easily slip from the player's grasp when strumming or picking the strings. For this reason, designers of stringed instrument accessories have designed various structures for storing picks within ready access of the musician. One particular type of known pick storage structure includes a pick housing or holding structure that is affixable to the surface of the instrument and is configured to hold a number of picks. Examples of this type of pick storage structure are disclosed in U.S. Pat, Nos. 4,135,431, 4,785,708, 5,488,892, 5,796,021 and 5,847,299. While such pick holding structures are typically effective at accomplishing their intended purpose, such structures are generally undesirable from a musician's perspective because they involve either modifying the instrument body or affixing a structure to the instrument body in such a manner that may adversely affect the instrument tone/sound or that may damage the instrument finish.

Another known type of pick storage structure includes a pick housing or holding structure that may be affixed or attached to an instrument support strap or to the musician. Examples of such pick storage structures are disclosed in U.S. Pat. Nos. 4,779,778, 5,299,485, 5,413,020, 5,739,445, Des. 309,674 and Des. 362,264. Such pick storage structures are generally undesirable as cumbersome and/or as requiring modifications to the support strap or other structure.

Yet another known type of pick storage structure includes a housing or holding structure that may be detachably affixed to a portion of the instrument or to one of the instrument accessories. Examples of such pick storage structures are disclosed in U.S. Pat. Nos. 4,067,255, 5,651,468, Des. 393,362 and Des. 355,667. Most of these pick storage structures present a drawback in that the picks are located remote from the musician and are therefore difficult to store/retrieve. Des. 393,362, on the other hand, discloses a pick storage pouch that includes an aperture suitable for connection to an instrument strap pin. However, the position of the pouch does not appear to be adjustable relative to the strap pin, and the configuration of the pin storage area is such that storage and retrieval of a pick is difficult and cumbersome.

What is therefore needed is a combination instrument strap locking and pick storage device that overcomes the drawbacks associated with the above-described devices. Such a combination strap locking and pick storage device should ideally be simple in its design, manufacture and use, and should further be independent of the instrument, support strap and musician.

SUMMARY OF THE INVENTION

The foregoing shortcomings of the prior art are addressed by the present invention. In accordance with one aspect of the present invention, a strap lock device comprises first and second arms, and a ring defined between each of the first and second arms. The first and second arms are biased away from each other to define a passage through the ring having a first cross-sectional area, wherein the first cross-sectional area defines an inner ring surface adapted to engage a shaft of a support strap attachment peg of a musical instrument. The first and second arms are biasable toward each other to temporarily increase the first cross-sectional area to a second larger cross-sectional area, wherein the second larger cross-sectional area is adapted to receive a head of the support strap attachment peg therethrough, and wherein the head has a larger cross-sectional area than a cross-sectional area of the shaft.

In accordance with another aspect of the present invention, a pick storage device for a stringed musical instrument comprises a first arm having a free end and an opposite end, a second arm having a free end and an opposite end, and a ring defined at the opposite ends of the first and second arms, wherein the ring is adapted to engage a support strap attachment peg of a musical instrument. The first and second arms define opposing channels therein extending from the free ends thereof toward the ring, wherein the channels are adapted to receive opposite edges of a flat pick therein for storage between the first and second arms.

In accordance with yet another aspect of the present invention, a combination strap lock and pick storage device comprises a first arm having a free end and an opposite end, a second arm having a free end and an opposite end, and a ring defined at the opposite ends of the first and second arms. The ring defines a passage therethrough, and the passage defines an inner ring surface adapted to engage a support strap attachment peg of a musical instrument. The first and second arms define opposing channels therein extending from the free ends thereof toward the ring, wherein the channels are adapted to receive opposite edges of a flat pick therein for storage between the first and second arms.

One object of the present invention is to provide a strap lock device for a musical instrument, and for a stringed musical instrument in particular.

Another object of the present invention is to provide a pick storage device attachable to a support strap peg of a stringed musical instrument.

Yet another object of the present invention is to provide a combination strap lock and pick storage device for a musical instrument, and for a stringed musical instrument in particular.

Still another object of the present invention is to provide such a combination strap lock and pick storage device for a stringed musical instrument that is attachable to a support strap peg of the instrument to thereby secure the support strap to the support strap peg while also providing a storage location for an auxiliary flat pick.

These and other objects of the present invention will become more apparent from the following description of the preferred embodiment.

DESCRIPTION OF THE PREFERRED EMBODIMENTS

Figure 1:
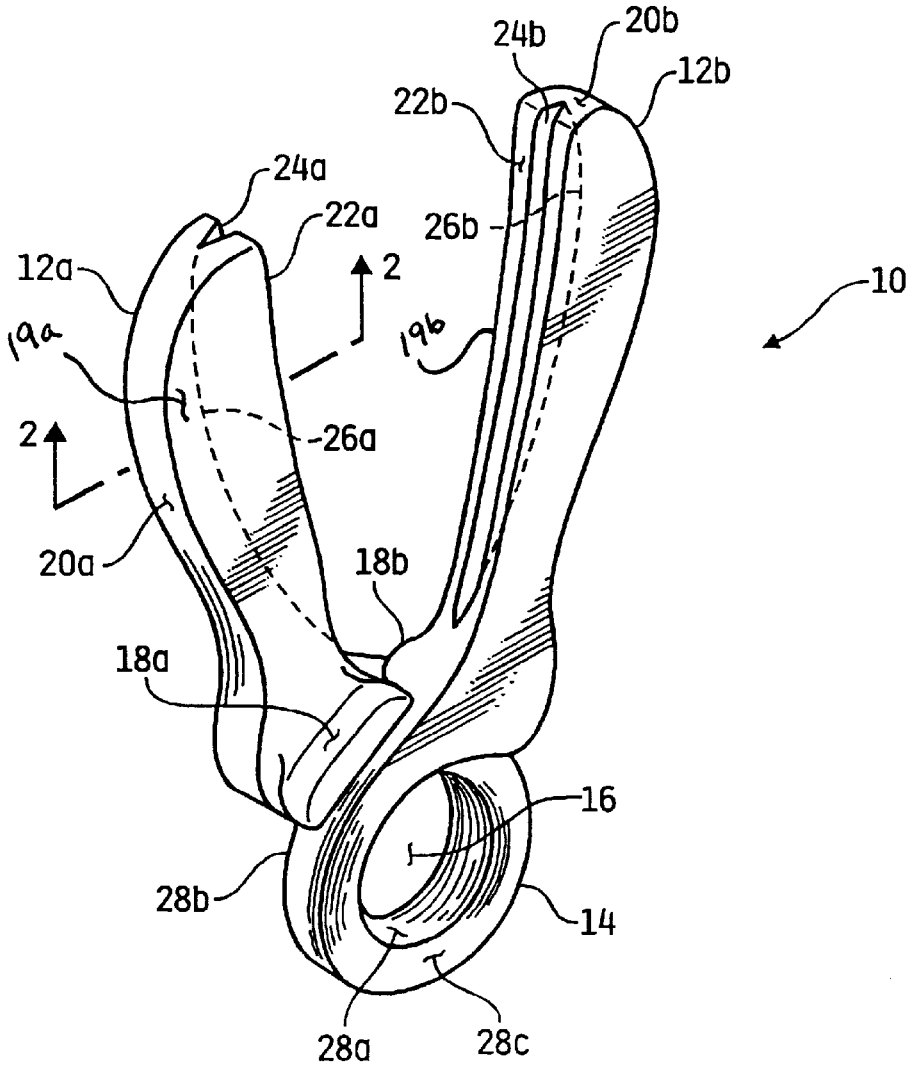
FIG. 1 is a front perspective view of one preferred embodiment of a combination strap lock and pick storage device, in accordance with the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated devices, and such further applications of the principles of the invention as illustrated therein being contemplated as would normally occur to one skilled in the art to which the invention relates.

Figure 2:
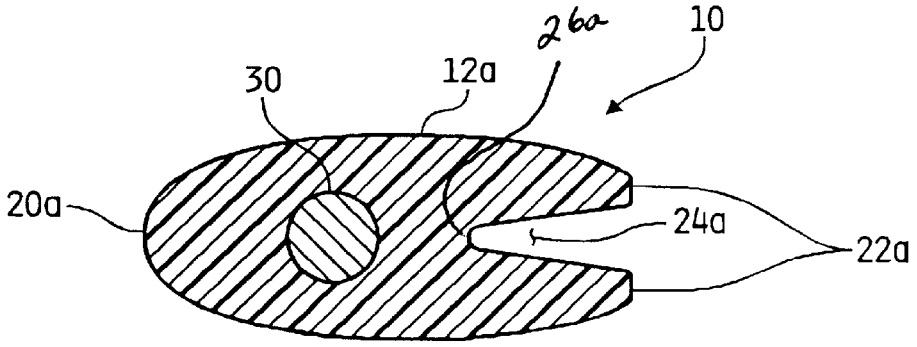
FIG. 2 is a cross-sectional view of the device illustrated in FIG. 1 as viewed along section lines 2—2.

Referring now to FIGS. 1 and 2, one preferred embodiment of a combination strap lock and pick storage device 10, in accordance with the present invention, is shown. Device 10 includes a first arm 12*a* and a second arm 12*b*, each having a free end and an opposite end forming a single ring 14 defining a passage 16 therethrough. In one embodiment, the ring 14 is preferably annular in shape and forms a substantially circular passage 16 therethrough, although the present invention contemplates that the ring 14 may be any desired shape forming a passage 16 therethrough having any desired configuration as will be described in greater detail hereinafter. Ring 14 defines an inside face 28*a* which itself defines the configuration of passage 16, a rear surface 28*b* and an opposite front surface 28*c*.

Each arm 12*a* and 12*b* further includes a corresponding protrusion 18*a* and 18*b* extending from corresponding front and rear faces 19*a* and 19*b* thereof adjacent to the ring 14.

In one preferred embodiment, protrusions 18*a* and 18*b* are positioned in slidable contact with an outer surface of the ring 14, although the present invention contemplates other configurations of protrusions 18*a* and 18*b,* wherein the purpose of any such protrusions 18*a* and 18*b* will be described in detail hereinafter.

Arm 12*a* of device 10 defines an outside face 20*a* and an opposite inside face 22*a,* and arm 12*b* similarly defines an outside face 20*b* and an opposite inside face 22*b*. Faces 22*a* and 22*b* each define a channel therein 24*a* and 24*b* respectively. In one preferred embodiment, channels 24*a* and 24*b* are identically configured, and each extend into faces 22*a* and 22*b* respectively to define arcuate-shaped channel surfaces 26*a* and 26*b* respectively as most clearly shown in FIG. 1, although the present invention contemplates other configurations of channel surfaces 26*a* and 26*b* as will be described in greater detail hereinafter.

In one embodiment, the combination strap lock and pick storage device 10 of the present invention is composed of a formable medium disposed about a steel or other metallic wire 30 as most clearly shown in FIG. 2. In one embodiment, device is formed of a plastic material, although the present invention contemplates constructing device 10 from other moldable materials such any of a variety of plastic resin materials, nylon, epoxy, or the like. Wire 30 is preferably included to provide device 10 with greater strength and further to bias arms 12*a* and 12*b* away from each other in a position similar to that shown in FIG. 1, although the present invention contemplates substituting other stiffening and biasing materials for wire 30. Alternatively still, the present invention contemplates omitting wire 30 altogether and constructing device 10 of a formable medium having sufficient strength and resilience to bias arms 12*a* and 12*b* away from each other in a position similar to that shown in FIG. 1.

Figure 3:
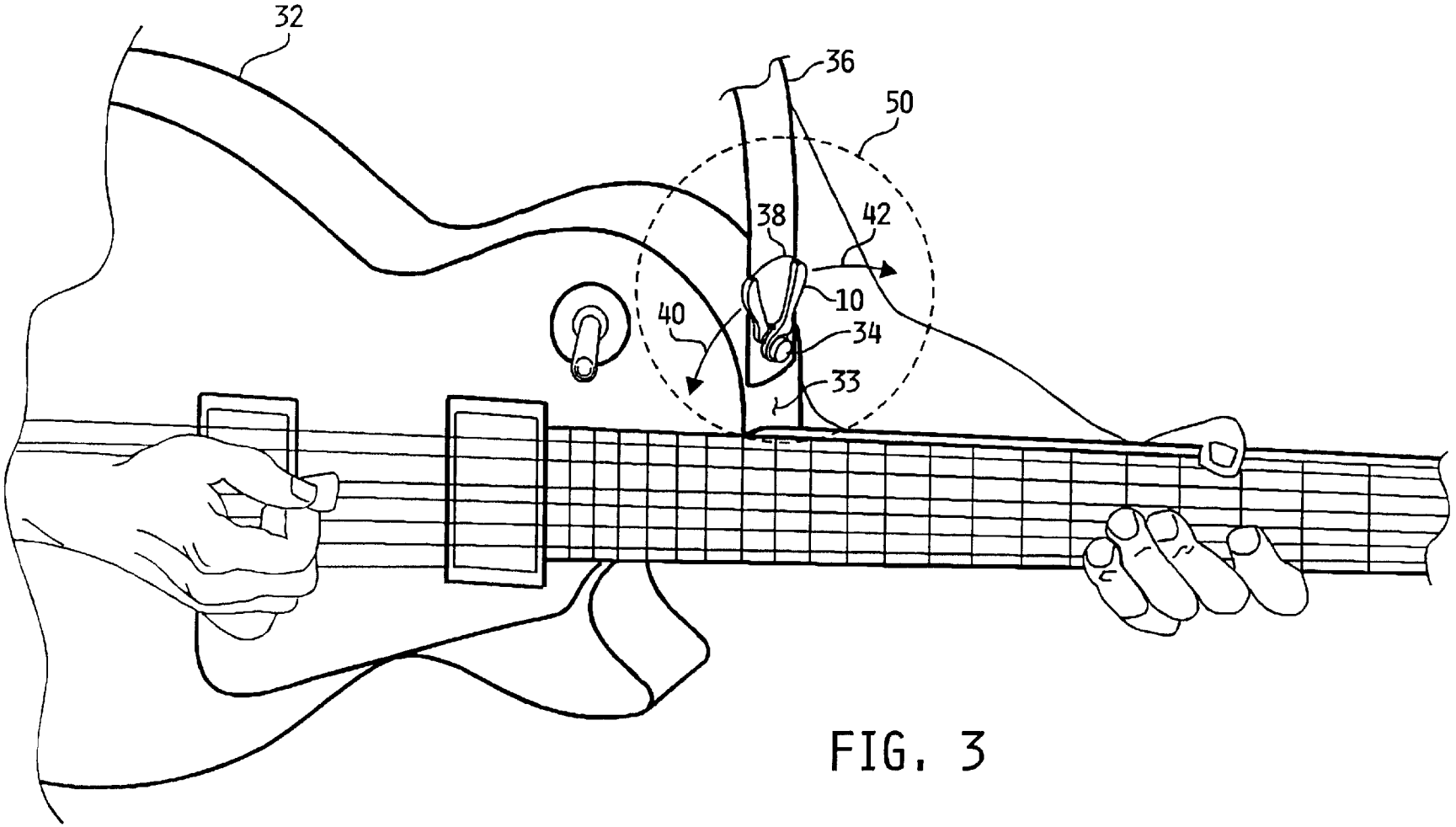
FIG. 3 is a perspective view of a strap supporting a guitar with the combination strap lock and pick storage device of FIGS. 1 and 2 attached thereto in accordance with the present invention.

Referring now to FIG. 3, a guitar 32 is shown having a peg 34 securely affixed to a surface 33 thereof and a support strap 36 attached to the peg 34, whereby the guitar 32 may be suspended by the strap 36 from an individual as shown. A combination strap lock and pick storage device 10 of the present invention is shown positioned about the peg 34 and over the strap 36 to thereby maintain connection of the strap 36 to the peg 34 as will be described in greater detail hereinafter.

Device 10 is illustrated in FIG. 3 as having a guitar pick 38 of known construction disposed within channels 24*a* and 24*b* of arms 12*a* and 12*b* respectively. The device 10 is preferably rotatably positionable about peg 34 as shown graphically by arrows 40 and 42. The term "rotatably positionable" as used with respect to device 10 should be understood to mean that device 10 may be rotated about peg 34 to thereby orient pick 38 in any desired position relative to the guitar 32 as indicated by arrows 40 and 42, wherein the device 10 is configured to maintain the desired position indefinitely.

Figure 4:
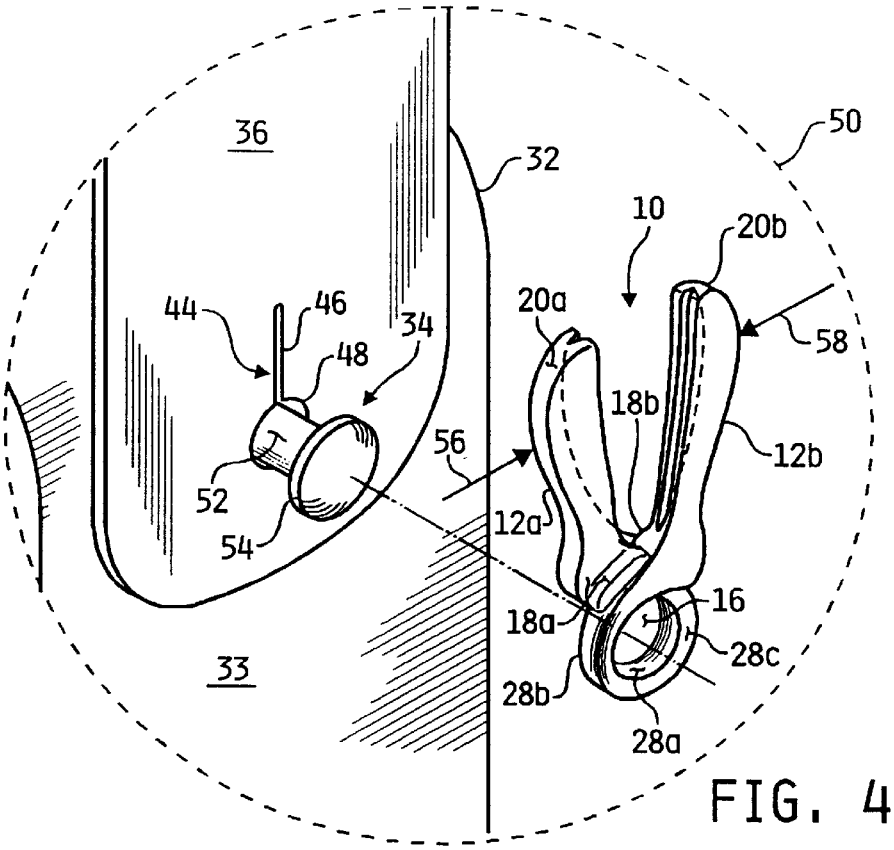
FIG. 4 is a magnified view of a portion of FIG. 3 illustrating attachment of the combination strap lock and pick storage device of FIGS. 1–3 to a guitar peg having a strap fastened thereto.
Figure 5:
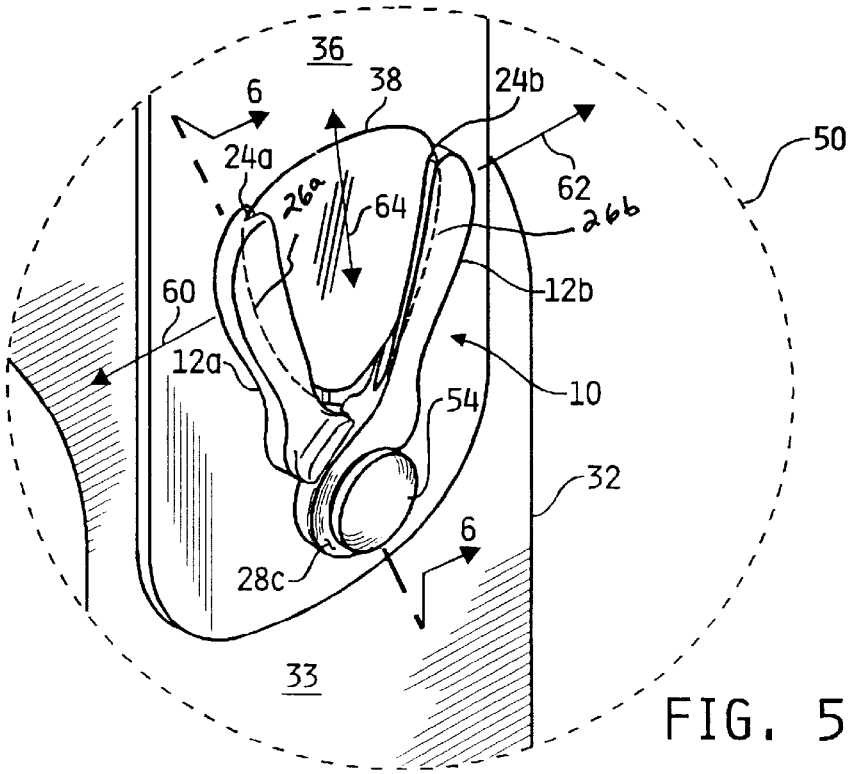
FIG. 5 is a magnified view similar to FIG. 4 illustrating the combination strap lock and pick storage device of FIGS. 1–4 attached to the guitar peg in a strap locking position.

Referring now to FIGS. 4 and 5, a magnified representation of region 50 of FIG. 3 is shown illustrating one preferred procedure for attaching device 10 to peg 34. As shown in detail in FIG. 4, strap 36 defines an aperture 44 of conventional design therethrough, wherein aperture 44 includes a hole 48 having a slit 46 extending therefrom. Peg 34 is also a conventional design having an enlarged head 54 extending from a shaft 52 having a cross-sectional area that is smaller than that of head 54. The opposite end of the shaft 52 is securely affixed to, or into, surface 33 of guitar 32. As is known in the art, the strap 36 is attached to the peg 34 by forcing aperture 44 over the head 54 of peg 34 and onto the shaft 52. As discussed in the BACKGROUND section, aperture 44 of strap 36 will eventually become enlarged due to deformation as a result of normal use thereof, wherein the cross-sectional area of head 54 may no longer be large enough to maintain the aperture 44 disposed about the shaft 52. The aperture 44 of strap 36 may thus slip over the head 54 and thereby disengage the strap from the peg 34 and guitar 32.

To combat this potentially dangerous condition, the combination strap lock and pick storage device 10 of the present invention is configured such that inner surface 28*a* of ring 14 may be temporarily increased, thereby enlarging the cross-sectional area of passage 16, in order to pass over head 54 of peg 34, and then returned to its original size to thereby engage shaft 52 about a substantial portion of its surface. To accomplish this, pressure is applied to each of the outer faces 20*a* and 20*b* of arms 12*a* and 12*b* respectively, as shown by arrows 56 and 58, such as by pinching arms 12*a* and 12*b* between a thumb and forefinger, so that arms 12*a* and 12*b* are biased toward each other. This inward biasing action of arms 12*a* and 12*b* causes protrusion 18*a* to move toward arm 12*b* and protrusion 18*b* to move toward arm 12*a,* which effectively increases the surface area of inner surface 28*a* and resultantly expands passage 16 to a cross-sectional area sufficient to pass over head 54 of peg 34. Without protrusions 18*a* and 18*b,* arms 12*a* and 12*b* may be over-biased toward each other in the above-described process to the extent that deformation of device 10 may result, and in this respect, protrusions 18*a* and 18*b,* or structural equivalents thereof, are preferably included to provide a positive stop to the inward biasing of arms 12*a* and 12*b* toward each other. It is to be understood, however, that the present invention contemplates constructing device 10 of a material or materials having sufficient strength and resiliency so that such deleterious effects of over-biasing are no longer present or possible and, in this case, protrusions 18*a* and 18*b* may be omitted.

With the inner surface 28*a* positioned about shaft 52, the pressure on outer faces 20*a* and 20*b* of arms 12*a* and 12*b* respectively is released, and the natural outward bias existing between arms 12*a* and 12*b* causes arms 12*a* and 12*b* to draw away from each other and return substantially to their original positions (see FIG. 1), thereby returning the surface area of the inner surface 28*a* of ring 14 to its original dimension and the cross-sectional area of opening 16 to its original cross-sectional area. Preferably, device 10 is configured so that the original cross-sectional area of opening 16 (i.e., with no external pressure applied to arms 12*a* and 12*b*) is sized such that the inner surface 28*a* of ring 14 contacts a substantial area of shaft 52 thereabout so that the device 10 may be rotatably positioned about shaft 52 as described hereinabove. Those skilled in the art will recognize that the shape and configuration of the ring 14 and opening 16 will generally be dictated by the corresponding shape and configuration of the shaft 52 and head 54 of the peg 34, although all such structures are illustrated in the drawings as having generally circular cross-sections.

In any event, the front and rear faces 28*c* and 28*b* respectively of ring 14 are preferably sized such that the entire ring 14, when affixed to shaft 52, is larger in cross-sectional area than the head 54 of peg 34 as shown in FIG. 5. The ring 14 is thus preferably sized to add sufficient cross-sectional area about shaft 52 so that the aperture 44, even though possibly enlarged due to repeated forcing of aperture 44 over head 54, will not pass over ring 14. In this manner, device 10 provides a strap locking feature when positioned about shaft 52 of peg 34 between head 54 and aperture 44 of strap 36.

As most clearly shown in FIG. 5, and as described hereinabove, inner faces 22*a* and 22*b* of arms 12*a* and 12*b* each define channels 24*a* and 24*b* therein, wherein such channels are preferably configured to receive first and second opposite edges of a conventional guitar pick therein, and retain the pick between arms 12*a* and 12*b*. In one preferred embodiment, and as described with respect to FIG. 1, the channel surfaces 26*a* and 26*b* are arcuate-shaped. Preferably the arcuate shape of channel surfaces 26*a* and 26*b* in this embodiment is complementary to first and second opposite edges of a conventional guitar pick configuration to thereby facilitate advancement and retrieval of a pick 38 within and from channels 24*a* and 24*b* as shown by the bi-directional arrow 64 of FIG. 5. It is to be understood, however, that channel surfaces 26*a* and 26*b* may alternatively be configured complementary to corresponding edges of any desired pick configuration to facilitate advancement and retrieval of any such pick configuration. In any case, and with further reference to FIG. 5, channel surfaces 26*a* and 26*b* preferably extend within inner surfaces 22*a* and 22*b* respectively of arms 12*a* and 12*b* to define a distance therebetween that is slightly narrower than the width of pick 38. Insertion of the pick 38 within channels 24*a* and 24*b* thus preferably causes a slight outward biasing of arms 12*a* and 12*b* away from each other, as illustrated graphically by biasing arrows 60 and 62, thereby causing a further reduction in the cross-sectional area of passage 16 to a cross-sectional area slightly less than that established by the natural outward biasing of arms 12*a* and 12*b* as described hereinabove. As a result, the inner surface 28*a* of ring 14 fits securely about shaft 52 of peg 34, yet the entire structure (device 10 with pick 28 inserted therein) is roatably positionable about shaft 52 as described hereinabove. This supplemental biasing of arms 12*a* and 12*b*, while not required, thus facilitates the ability to fixedly locate device 10 at any desired position relative to the guitar 32 and/or strap 36.

Figure 6:
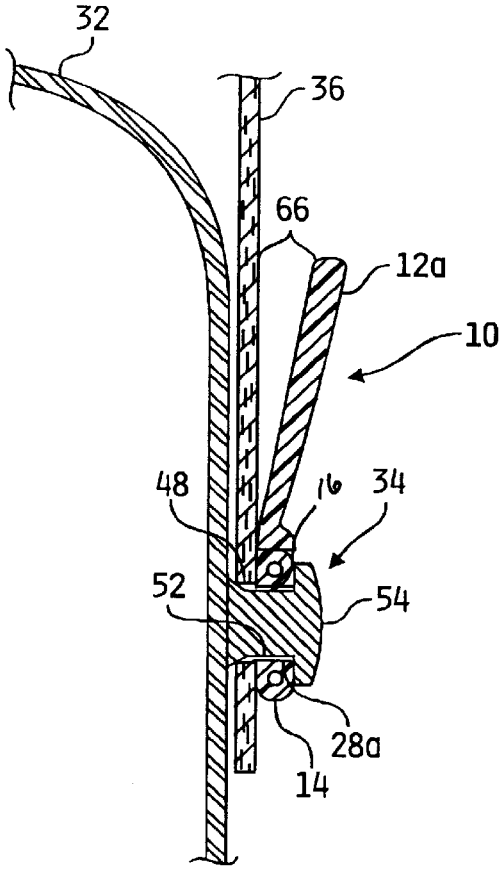
FIG. 6 is a cross-sectional view of the guitar, strap, peg and combination strap lock and pick storage device of FIG. 5 viewed along section lines 6—6.

Referring now to FIG. 6, a cross-section of device 10, strap 36, peg 34 and guitar 32, viewed along section lines 6—6 of FIG. 5, is shown illustrating another preferred feature of device 10. In particular, arms 12*a* and 12*b* are preferably disposed at an acute angle relative to a first axis perpendicular to a second axis defined through a center of opening 16 in ring 14. As shown in FIG. 6, arms 12*a* and 12*b* are disposed at an acute angle 66 relative to a vertical axis normal to a horizontal axis defined longitudinally through the center of the peg 34, to thereby provide some clearance between the arms 12*a* and 12*b* and the support strap 36. Preferably, sufficient clearance is provided to allow a finger or thumb to slide between the strap 36 and a pick 38 stored within channels 24*a* and 24*b* to thereby facilitate advancement and withdrawal of the pick 38 within and from device 10. Preferably, arms 12*a* and 12*b* are angled from the free ends thereof to approximately the locations of protrusions 18*a* and 18*b*, although the present invention contemplates angling or bowing any portion of arms 12*a* and 12*b* to thereby provide some clearance between the back faces 19*b* thereof and the strap 36.

Figure 7:
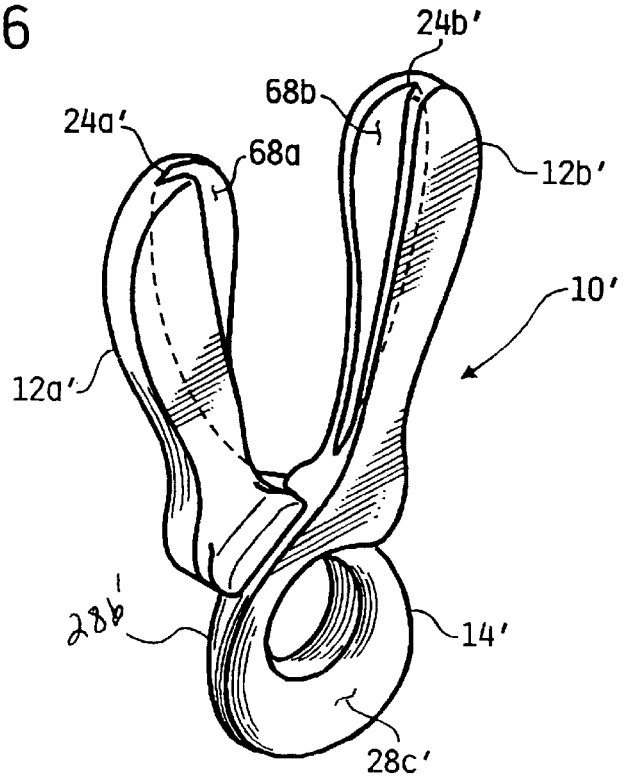
FIG. 7 is a front perspective view of an alternate embodiment of a combination strap lock and pick storage device, in accordance with the present invention.

Referring now to FIG. 7, an alternate embodiment 10' of a combination strap lock and pick storage device, in accordance with the present invention, is shown. Device 10' is identical in many respects to device 10 illustrated in FIGS. 1–6 with at least two exceptions. First, the front face 28*c*' and back face 28*b*' of ring 14' are extended to form a flange rather than a ring-like structure as shown in FIG. 1. The flange formed by faces 28*b*' and 28*c*' is intended to illustrate that ring 14 may be sized to form any desired outer diameter for any correspondingly sized peg 34 and/or for increased strap locking capability. Second, arms 12*a*' and 12*b*' have been reconfigured to provide for a pair of wing-like structures 68*a* and 68*b* extending at least partially along one edge of corresponding channels 24*a*' and 24*b*' to act as guides for facilitating advancement of a pick 38 within channels 24*a*' and 24*b*'. Preferably, the wing-like structures 68*a* and 68*b* extend along only a portion of channels 24*a*' and 24*b*' near the free ends of arms 12*a*' and 12*b*', although the present invention contemplates other configurations of wing-like structures 68*a* and 68*b*.

Figure 8:
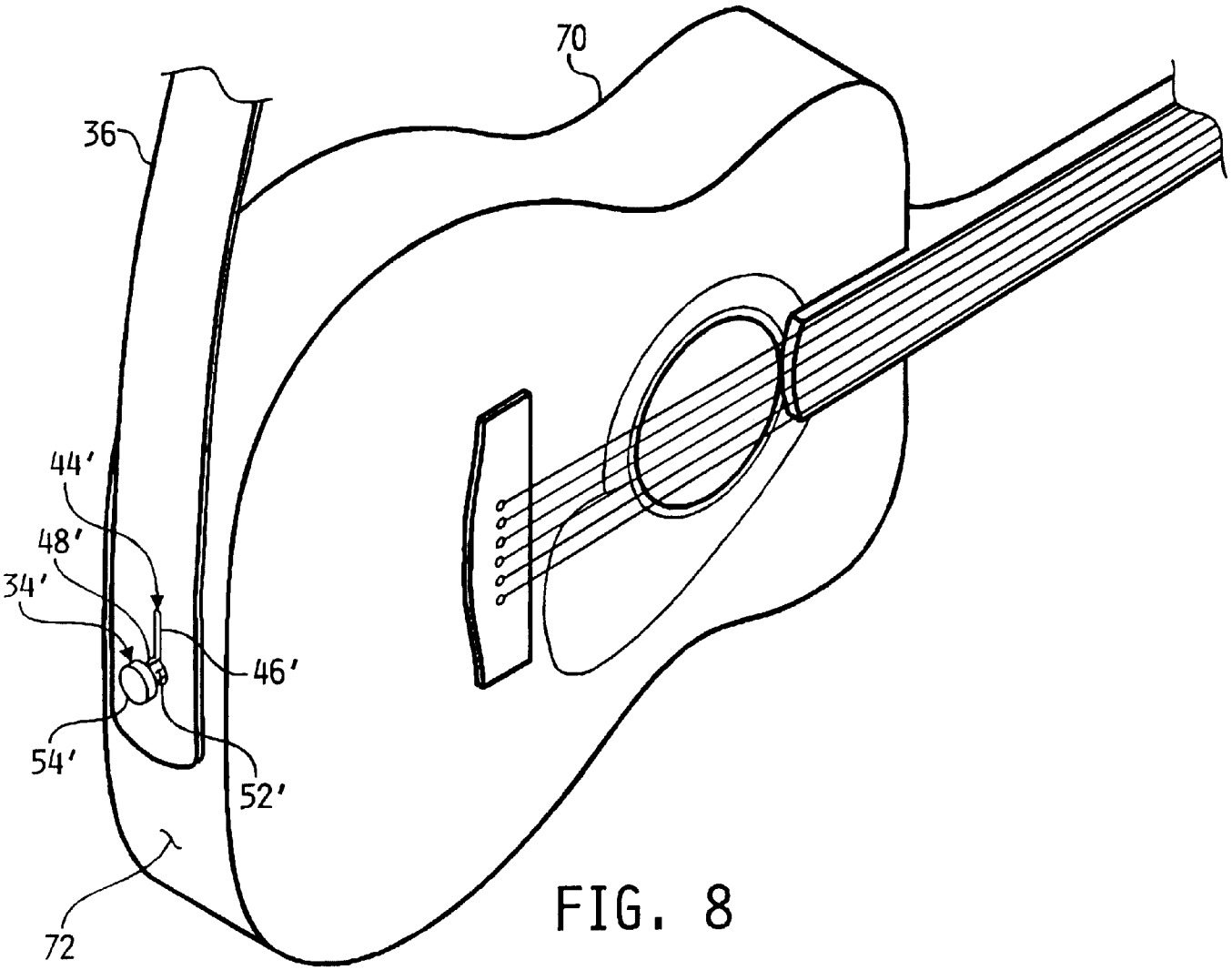
FIG. 8 is a perspective view of a rear portion of a guitar having a strap attached thereto illustrating an alternate or additional location of one of the combination strap lock and pick storage devices of the present invention.

Referring now to FIG. 8, a front perspective view of another guitar 70 is shown illustrating the location of a rear peg 34' that is conventionally affixed centrally to the bottom 72 of the guitar 70. As with the front peg 34 illustrated in FIGS. 3–6, the rear peg 34' includes an enlarged head 54' having a shaft 52' extending therefrom wherein the shaft 52' defines a cross-sectional area that is less than that of head 54'. The free end of peg 34' is typically affixed to, or within, the bottom 72 of the guitar 70. The strap 36 likewise defines a second aperture 44' therethrough similar to the first aperture 44 defined at the opposite end, including an opening 48' having a slit 46' extending therefrom. The strap 36 may be connected to peg 34' in a manner similar to that described with respect to peg 34, whereby a combination strap lock and pick storage device 10 or 10' of the present invention may be attached to peg 34' in an identical manner to that described with respect to peg 34.

It will be apparent to those skilled in the art that the combination strap lock and pick storage device 10 or 10' of the present invention may be used strictly in its capacity as a strap locking device wherein one such device may be attached to peg 34 or 34' to thereby secure the strap 36 to a guitar 32 or 70 at a location that has a tendency to become unconnected in the normal course of use, or wherein two such devices may be attached to pegs 34 and 34' to thereby cheaply, easily and securely lock a strap 36 to a guitar 32 or 70. Alternatively, the combination strap lock and pick storage device 10 or 10' of the present invention may be used strictly in its capacity as a pick storage device wherein one or more such devices 10 or 10' may be attached to a peg 34 or 34', with or without a strap 36 connected thereto, to provide for one or more easily accessible surplus of picks. Alternatively still, the combination strap lock and pick storage device 10 or 10' of the present invention may be used in its dual capacity as a strap locking device and pick storage device wherein one or more such devices 10 or 10' may be attached to an appropriate peg 34 or 34' to thereby secure a support strap 36 to a guitar 32 or 70, and wherein a pick may be stored within each such device 10 or 10' to thereby provide one or more easily accessible surplus of picks.

While the invention has been illustrated and described in detail in the foregoing drawings and description, the same is to be considered as illustrative and not restrictive in character, it being understood that only the preferred embodiments have been shown and described and that all changes and modifications that come within the spirit of the invention are desired to be protected. For example, while the device 10 or 10' of the present invention has been shown and described for use with a guitar 32 or 70, those skilled in the art will recognize that either device 10 or 10' may alternatively be used in its capacity as a strap locking device, pick storage device, or both, with a variety of other stringed instruments or other portable accessories. Examples of such other stringed instruments or other portable accessories may include, but are not limited to, banjos, mandolins, ukuleles, accordions, portable keyboards, portable cameras, portable video equipment, and the like.

What is claimed is:

1. A combination strap lock and pick storage device, comprising:

a first arm having a free end and an opposite end;

a second arm having a free end and an opposite end; and a ring defined at said opposite ends of said first and second arms, said ring defining a passage therethrough, said passage defining an inner ring surface configured for engaging a support strap attachment peg of a musical instrument;

wherein said first and second arms define opposing channels therein extending from said free ends thereof toward said ring, said channels configured for receiving opposite edges of a flat pick therein for storage between said first and second arms.

2. The combination strap lock and pick storage device of claim 1 wherein said first and second arms are biased away from each other to establish a first cross-sectional area of said passage, said first cross-sectional area of said passage defining a corresponding area of said inner ring surface configured for engaging a shaft of said support strap attachment peg.

3. The combination strap lock and pick storage device of claim 2 wherein said first and second arms are biasable toward each other to temporarily increase said first cross-sectional area of said passage to a second larger cross-sectional area configured for receiving a head of said support strap attachment peg therethrough, said head having a cross-sectional area larger than a cross-sectional area of said shaft.

4. The combination strap lock and pick storage device of claim 3 wherein said first arm includes a first protrusion adjacent said ring and said second arm includes a second protrusion adjacent said ring, said first and second protrusions preventing over biasing of said arms toward each other.

5. The combination strap lock and pick storage device of claim 3 further including a flat pick defining a first edge and an opposite second edge, said first edge disposed in one of said opposing channels and said second edge disposed in the other of said opposing channels, said pick trapped within said opposing channels between said first and second arms.

6. The combination strap lock and pick storage device of claim 5 wherein said first and second arms are further biased away from each other under a force of said first and second edges of said pick against said opposing channels to establish a third cross-sectional area of said passage less than said first cross-sectional area, said third cross-sectional area of said passage defining a corresponding area of said inner ring surface configured for securing said device to said shaft of said support strap attachment peg.

7. The combination strap lock and pick storage device of claim 5 wherein said inner ring surface is rotatably positionable about said support strap attachment peg to thereby position said pick at a desired location relative to said musical instrument.

8. The combination strap lock and pick storage device of claim 1 wherein said ring defines a front and rear face sized to have a larger cross sectional area than a cross-sectional area of said support strap attachment peg.

9. The combination strap lock and pick storage device of claim 1 wherein said inner ring surface is rotatably positionable about said support strap attachment peg to thereby position said first and second arms at desired locations relative to said musical instrument.

10. A strap lock device, comprising:

first and second arms; and a ring defined between each of said first and second arms, said first and second arms biased away from each other to define a passage through said ring having a first cross-sectional area, said first cross-sectional area defining an inner ring surface configured for engaging a shaft of an attachment peg of a musical instrument;

wherein said first and second arms are biasable toward each other to temporarily increase said first cross-sectional area to a second larger cross-sectional area, said second larger cross-sectional area sized to receive a head of said attachment peg therethrough, said head having a larger cross-sectional area than a cross-sectional area of said shaft;

and wherein said first arm includes a first protrusion adjacent said ring and said second arm includes a second protrusion adjacent said ring, said first and second protrusions preventing over biasing of said arms toward each other.

11. The strap lock device of claim 10 wherein said ring defines a front and rear face sized to have a larger cross sectional area than said cross-sectional area of said head.

12. The strap lock device of claim 10 wherein said inner ring surface is rotatably positionable about said shaft of said attachment peg to thereby position said first and second arms at a desired location relative to said musical instrument.

13. A pick storage device for a stringed musical instrument, comprising:

a first arm having a free end and an opposite end;

a second arm having a free end and an opposite end; and a ring defined at said opposite ends of said first and second arms;

wherein said first and second arms define opposing channels therein extending from said free ends thereof toward said ring, said channels adapted to receive opposite edges of a flat pick therein for storage between said first and second arms.

14. The pick storage device of claim 13 wherein said ring is configured for engaging a support strap attachment peg of a musical instrument;

and wherein said ring is rotatably positionable about said support strap attachment peg to thereby position said first and second arms at desired locations relative to said musical instrument.

15. The pick storage device of claim 13 further including a flat pick defining a first edge and an opposite second edge, said first edge disposed in one of said opposing channels and said second edge disposed in the other of said opposing channels, said pick trapped within said opposing channels between said first and second arms.

16. The pick storage device of claim 15 wherein said ring is configured for engaging a support strap attachment peg of a musical instrument;

and wherein said ring is rotatably positionable about said support strap attachment peg to thereby position said pick at a desired location relative to said musical instrument.

17. The pick storage device of claim 15 wherein said ring defines a passage therethrough.

18. The pick storage device of claim 17 wherein said first and second arms are biased away from each other to establish a first cross-sectional area of said passage, said first cross-sectional area of said passage defining a corresponding area of said inner ring surface configured for engaging a support strap attachment peg.

19. The pick storage device of claim 18 wherein said first and second arms are further biased away from each other under a force of said first and second edges of said pick against said opposing channels to establish a second cross-sectional area of said passage less than said first cross-sectional area, said second cross-sectional area of said passage defining a corresponding area of said inner ring surface sized to secure said device to said support strap attachment peg.

* * * * *